US007355581B2

(12) United States Patent
Kim

(10) Patent No.: US 7,355,581 B2
(45) Date of Patent: Apr. 8, 2008

(54) ANALOG BUFFER CIRCUIT FOR LIQUID CRYSTAL DISPLAY DEVICE

(75) Inventor: Kee Jong Kim, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 662 days.

(21) Appl. No.: 10/875,733

(22) Filed: Jun. 25, 2004

(65) Prior Publication Data

US 2005/0001799 A1 Jan. 6, 2005

(30) Foreign Application Priority Data

Jul. 2, 2003 (KR) ..... 10-2003-0044605

(51) Int. Cl.
*G09G 3/36* (2006.01)

(52) U.S. Cl. ..... 345/98; 345/100

(58) Field of Classification Search ..... 345/87, 345/155–158, 92, 98; 327/95, 108
See application file for complete search history.

(56) References Cited

U.S. PATENT DOCUMENTS 6,801,186 B2 * 10/2004 Han et al. ..... 345/103
6,820,176 B2 * 11/2004 Heisch ..... 711/152
2004/0189568 A1 * 9/2004 Lee et al. ..... 345/89

FOREIGN PATENT DOCUMENTS

JP 10-013166 1/1998
KR 1997-0005838 4/1997

OTHER PUBLICATIONS

High Performance, Low-Power Integrated 8-bit Digital Data Driver for Poly-Si TFT-LCD's□□Seung-Woo Lee, Hoon-Ju Chung, Jin-woo Lee, and Chui-Hi Han□□SID Symposium Digest 30, 76 (1999)□□.*

* cited by examiner

*Primary Examiner*—Chanh D. Nguyen
*Assistant Examiner*—Calvin Ma
(74) *Attorney, Agent, or Firm*—Morgan, Lewis & Bockius LLP

(57) ABSTRACT

An analog buffer circuit for a liquid crystal display (LCD) device includes a first capacitor and an inverter connected in series between an input terminal and an output terminal, a first reset switch connected between the input terminal and the first capacitor to reset the first capacitor, a first feedback switch connected to a first node between the first capacitor and the first reset switch, a second capacitor and a second feedback switch connected in series between a second node and a third node, the second node connected between the first capacitor and the inverter, and the third node connected between the inverter and the output terminal, a second reset switch connected between the second node and the third node to reset the inverter, and a third reset switch connected to a fourth node between the second capacitor and the second feedback switch to reset the second capacitor.

9 Claims, 8 Drawing Sheets

ANALOG BUFFER CIRCUIT FOR LIQUID CRYSTAL DISPLAY DEVICE

The present invention claims the benefit of Korean Patent Application No. P2003-44605, filed on Jul. 2, 2003, which is hereby incorporated by reference.

BACKGROUND OF THE INVENTION

1. Field of the Invention

The present invention relates to a driving circuit for a liquid crystal display (LCD) device, and more particularly, to an analog buffer circuit for an LCD device.

2. Discussion of the Related Art

As demand for various display devices increases, development of various flat display devices, such as liquid crystal display (LCD) devices, plasma display panel (PDP) devices, electroluminescent display (ELD) devices, and vacuum fluorescent display (VFD) devices, has begun. These flat display devices are commonly used because of their thin profile, light weight, and low power consumption. For example, the LCD devices are commonly used in notebook computer, computer monitors, and televisions.

In general, an LCD device includes an LCD panel displaying images and an external driving circuit supplying driving signals to the LCD panel. The LCD panel includes first and second transparent substrates, such as glass substrates, bonded to each other and having a predetermined interval therebetween, and a liquid crystal material injected between the first and second substrates. The first substrate includes a plurality of gate and data lines crossing each other to define a plurality of pixel regions, a plurality of pixel electrodes disposed within each of the pixel regions, and a plurality of thin film transistors disposed at crossing portions of the gate and data lines to supply video signals transmitted along the data lines to respective ones of the pixel electrodes according to gate signals transmitted along the gate lines. The second substrate includes a black matrix layer, a color filter layer, and a common electrode. Accordingly, as turn-ON signals are sequentially supplied to the gate lines, the data signals are transmitted to the pixel electrodes of the corresponding data line, thereby displaying images.

In addition, a backlight device is provided at a rear side of the two substrates, and uses a cold cathode fluorescent lamp (CCFL) as a light source. Accordingly, luminance is inversely proportional to a lifespan of the CCFL. When driving the backlight device at a high voltage for increased luminance, the lifespan of the backlight device decreases. Accordingly, increasing the lifespan of the backlight device may be accomplished by driving the backlight device at a low voltage. However, it is difficult to improve the luminance of the backlight device. Thus, a backlight device having both a long lifespan and high luminance is required. One solution is to momentarily supply a high voltage to the lamp of the backlight device when driving the LCD panel. Accordingly, the amount of current for the lamp of the backlight device is changed according to the image displayed on the LCD panel. For example, during a normally white mode wherein incident light is prevented from being transmitted by the LCD panel by aligning liquid crystal molecules along an electric field direction, the power consumption of the LCD panel decreases as the number of active pixels on the LCD panel increases. Conversely, the power consumption of the LCD panel increases as the number of dark (inactive) pixels on the LCD panel increases. Accordingly, it is possible to control the current value for the lamp on the basis of the power consumption for the LCD panel. Thus, an additional circuit is required for detecting the current consumed by the LCD panel, wherein changing the detected current is necessary for meeting a variable range of luminance control signals of the inverter for driving the backlight device.

FIG. 1A is a schematic plan view of a-Si TFT-LCD device according to the related art, and FIG. 1B is a schematic plan view of a polysilicon TFT-LCD device according to the related art. In FIG. 1A, an amorphous silicon thin film transistor LCD (a-Si TFT-LCD) device includes a thin film transistor (TFT) array 3 formed on a first substrate 1, data and gate drivers 6 and 8 for driving the TFT array 3, and a printed circuit board (PCB) substrate 4 interconnecting the TFT array 3 with the data and gate drivers 6 and 8. In the a-Si TFT-LCD device, the data and gate drivers 6 and 8 are formed at an exterior of the first substrate 1 due to the low field mobility of the a-Si TFT-LCD device, whereby a total number of signal lines for electrical connection increases.

In FIG. 1B, a polysilicon thin film transistor LCD (poly-Si TFT-LCD) device includes a TFT array 5 on a substrate 2, and data and gate drivers 7 and 9 for driving the TFT array 5. The poly-Si TFT-LCD device has a driving circuit for the data and gate drivers 7 and 9 within the substrate 2, thereby decreasing a total number of signal lines for electrical connection and improving reliability and yield. In addition, since the poly-Si TFT has a high field mobility and a smaller size than the a-Si TFT, the poly-Si TFT functions as a pixel switch, thereby improving aperture ratio of the a-Si TFT-LCD device.

FIG. 2 is a schematic block diagram of a driving circuit for an LCD device according to the related art. In FIG. 2, an LCD device includes an LCD panel 21, a driving circuit part 22, and a backlight device 28. The LCD panel 21 includes a plurality of pixel regions arranged in a matrix-type configuration, wherein each pixel region is defined by a crossing of a gate line G and a data line D. The driving circuit part 22 supplies driving and data signals to the LCD panel 21, and the backlight device 28 provides light to the LCD panel 21.

The driving circuit part 22 includes a data driver 21*b*, a gate driver 21*a*, a timing controller 23, a power supply part 24, a gamma reference voltage part 25, an AC/DC converter 26, and an lamp driving part 29. Accordingly, the data driver 21*b* inputs a data signal to each of the data lines D of the LCD panel 21, and the gate driver 21*a* supplies a gate driving pulse to each of the gate lines G of the LCD panel 21. Then, the timing controller 23 receives display data R/G/B, vertical and horizontal synchronous signals Vsync and Hsync, a clock signal DCLK, and control signals from a driving system 27 of the LCD panel 21. Accordingly, the timing controller 23 formats the display data R/G/B, the clock signal DCLK, and the control signals having a timing suitable for restoring an image by the gate driver 21*a* and the data driver 21*b* of the LCD panel 21. In addition, the gamma reference voltage part 25 receives power from the power supply part 24 to provide a reference voltage required when digital data input from the data driver 21*b* is converted into analog data. The AC/DC converter 26 outputs a constant voltage $V_{DD}$, a gate high voltage $V_{GH}$, a gate low voltage $V_{GL}$, a reference voltage $V_{ref}$, and a common voltage $V_{com}$ for the LCD panel 1 by using a voltage output from the power supply part 24. Accordingly, the lamp driving part 29 drives the backlight device 28.

Operation of the LCD device includes the timing controller 23 receiving the display data R/G/B, the vertical and horizontal synchronous signals Vsync and Hsync, the clock signal DCLK, and the control signals from the driving system 27 of the LCD panel 21, and providing the display data R/G/B, the clock signal DCLK, and the control signals formatted having the timing suitable for restoring the image by the data driver 21*b* and the gate driver 21*a* of the LCD panel 21. For example, the gate driver 21*a* supplies the gate driving pulse to each of the gate lines G of the LCD panel 21, and the synchronous data driver 21*b* inputs the data signals to each of the data lines D of the LCD panel 21, thereby displaying the input image. At this time, the backlight device 28 provides constant brightness without relation to luminance of the input image signals.

FIG. 3 is a schematic block diagram of a data driver in FIG. 2 according to the related art. In FIG. 3, the data driver 21*b* (in FIG. 2) includes a shift register 31, a sampling latch 32, a holding latch 33, a D/A (digital/analog) converter 34, and an output buffer 35. The shift register 31 shifts a horizontal synchronous signal pulse Hsync through a source pulse clock HCLK, and outputs a latch enable clock to the sampling latch 32. Subsequently, the sampling latch 32 samples the R, G, and B digital data for each column line in accordance with the latch enable clock output from the shift register 31, and then latches the sampled R, G, and B data. Next, the holding latch 33 latches the R, G, and B data latched by the sampling latch 32 through a load signal LD, and the D/A converter 34 converts the R, G, and B digital data latched by the holding latch 33 into analog signals. Then, the amplifier 35 amplifies the R, G, and B data converted into the analog signals at a certain width, and outputs the amplified R, G, and B data to each of the data lines D (in FIG. 2) of the LCD panel 21 (in FIG. 2). Accordingly, the data driver 21*b* (in FIG. 2) samples and holds the R, G, and B digital data during one horizontal period, converts them into analog data, and amplifies the converted analog data at a certain width. If the holding latch 33 holds the R, G, and B data to be applied to an nth numbered column line, then the sampling latch 32 samples the R, G, and B data to be applied to an (n+1)th numbered column line.

FIG. 4 is a schematic block diagram of a gate driver in FIG. 2 according to the related art. In FIG. 4, the gate driver 21*a* (in FIG. 2) includes a shift register 41, a level shifter 42, and an output buffer 43. The shift register 41 shifts the vertical synchronous signal pulse Vsync through a gate pulse clock VCLK, thereby sequentially enabling scanning lines. Subsequently, the level shifter 42 sequentially level-shifts signals applied to the scanning lines, and then outputs the level-shifted signals to the output buffer 43. Accordingly, the plurality of scanning lines connected with the output buffer 43 are sequentially enabled.

FIG. 5 is a schematic circuit diagram of an analog buffer circuit for an LCD device according to the related art. In FIG.5, an analog buffer circuit for an LCD device includes an input terminal, an output terminal, a capacitor 44, an inverter 45, a first reset switch 46, a second reset switch 47, and a feedback switch 48. The capacitor 44 and the inverter 45 are connected in series between the input terminal and the output terminal, and the first reset switch 46 is connected to a first node P1 between the input terminal and the capacitor 44 to reset the capacitor 44. In addition, the second reset switch 47 is connected between a second node P2 and a third node P3 to reset the inverter 45, wherein the second node P2 is connected between the capacitor 44 and the inverter 45, and the third node P3 is connected between the inverter 45 and the output terminal. Furthermore, the feedback switch 48 is connected between the second node P2 and the third node P3.

Operation of the analog buffer circuit for the LCD device includes initialization on an output terminal of the inverter 45 such that the first and second reset switches 46 and 47 are closed, whereby input and output of the inverter 45 is initialized to an intermediate potential of a power voltage. Subsequently, an analog data voltage and a video signal are input to an external DAC (not shown) from the input terminal. Then, a voltage corresponding to a difference between the initialized intermediate voltage and an input voltage is stored in the capacitor 44. When the feedback switch 48 is closed, the analog data voltage input to the input terminal is monitored through the inverter 45 and the output terminal. Accordingly, the analog buffer circuit simply uses the inverter 45, thereby decreasing the power consumption, as compared with that of an analog buffer circuit according to the related that uses an OP lamp.

However, the analog buffer circuit according to the related art has the following disadvantages. First, although the input voltage is applied to the output line, the inverter of the analog buffer circuit, as shown in FIG. 5, maintains the intermediate voltage, thereby increasing the power consumption due to standby current. In addition to the amplifier for the analog buffer function, an additional D/A converter and an analog buffer are required. Furthermore, the data output through the output terminal, as shown in FIG. 6, is unstable due to oscillation.

SUMMARY OF THE INVENTION

Accordingly, the present invention is directed to an analog buffer circuit for an LCD device that substantially obviates one or more problems due to limitations and disadvantages of the related art.

An object of the present invention is to provide an analog buffer circuit for an LCD device that drives a data driver in a stable manner.

Another object of the present invention is to provide an analog buffer circuit for an LCD device having a decreased power consumption.

Additional features and advantages will be set forth in the description which follows, and in part will be apparent from the description, or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described, an analog buffer circuit for a liquid crystal display (LCD) device includes a first capacitor and an inverter connected in series between an input terminal and an output terminal, a first reset switch connected between the input terminal and the first capacitor to reset the first capacitor, a first feedback switch connected to a first node between the first capacitor and the first reset switch, a second capacitor and a second feedback switch connected in series between a second node and a third node, the second node connected between the first capacitor and the inverter, and the third node connected between the inverter and the output terminal, a second reset switch connected between the second node and the third node to reset the inverter, and a third reset switch connected to a fourth node between the second capacitor and the second feedback switch to reset the second capacitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Figure 1A:
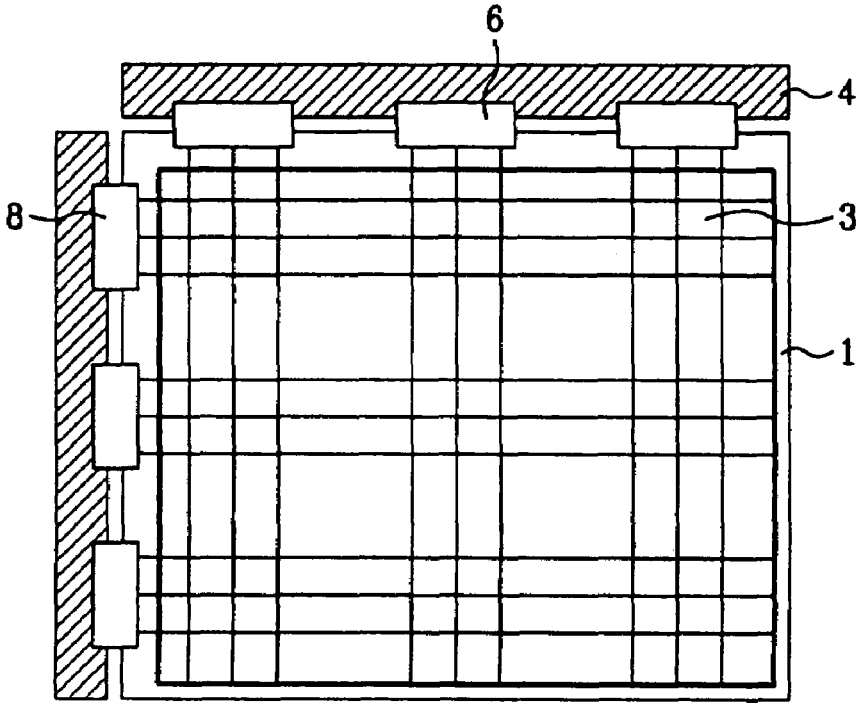
FIG. 1A Related Art
FIG. 1A is a schematic plan view of a-Si TFT-LCD device according to the related art.
Figure 1B:
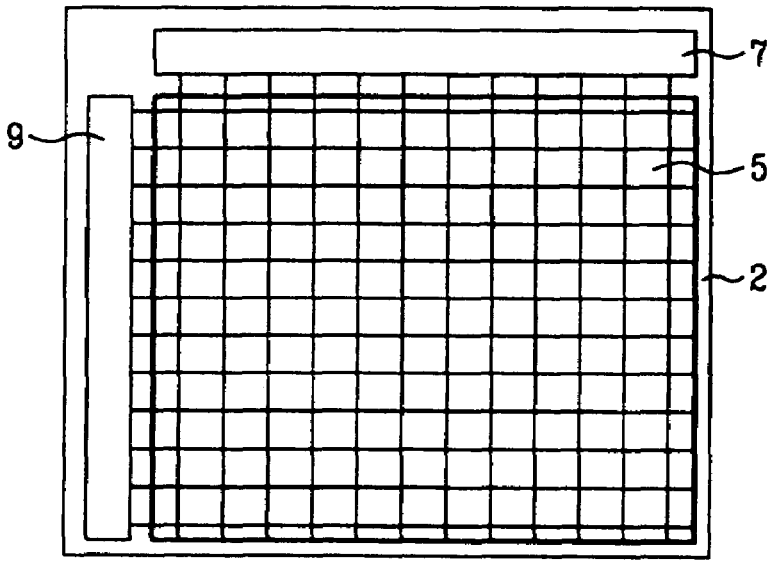
FIG. 1B Related Art
FIG. 1B is a schematic plan view of a polysilicon TFT-LCD device according to the related art.
Figure 2:
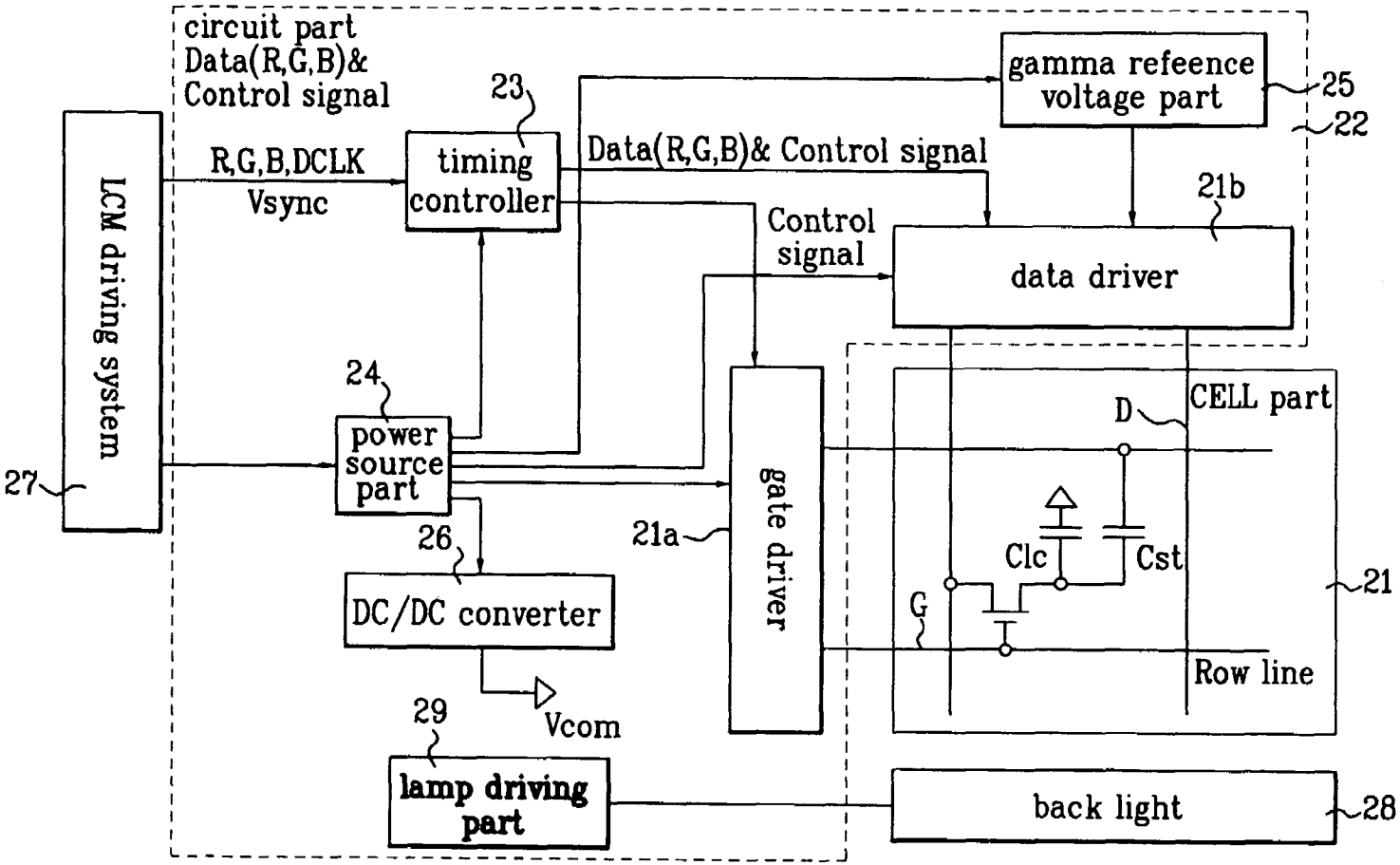
FIG. 2 Related Art
FIG. 2 is a schematic block diagram of a driving circuit for an LCD device according to the related art.
Figure 3:
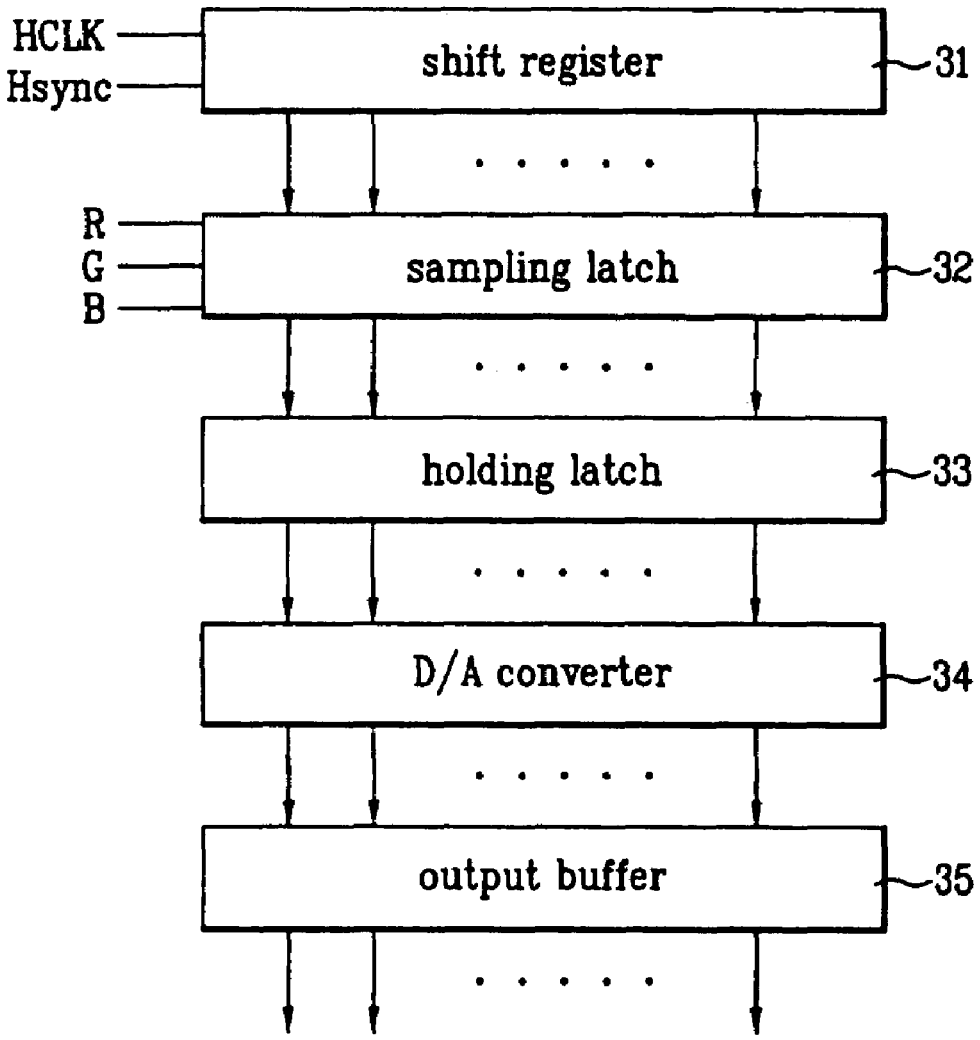
FIG. 3 Related Art
FIG. 3 is a schematic block diagram of a data driver in FIG. 2 according to the related art.
Figure 4:
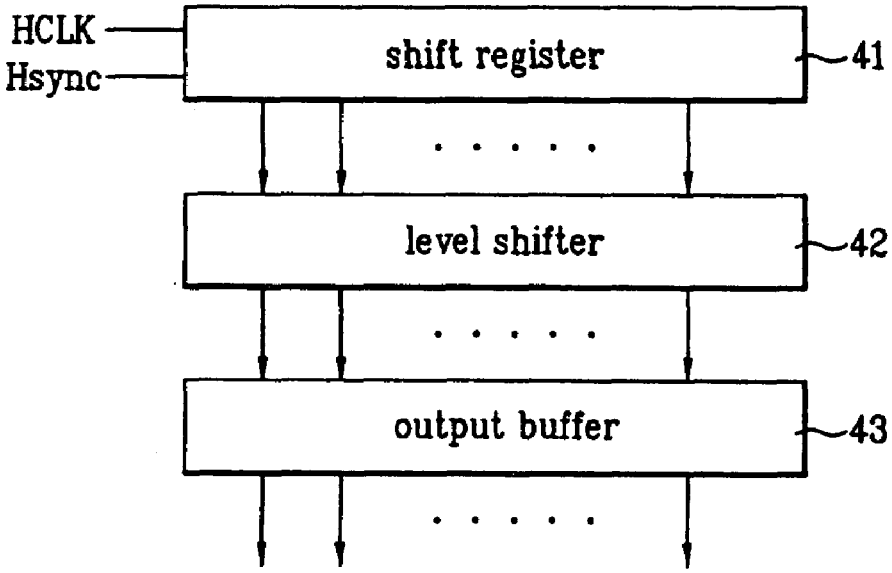
FIG. 4 Related Art
FIG. 4 is a schematic block diagram of a gate driver in FIG. 2 according to the related art.
Figure 5:
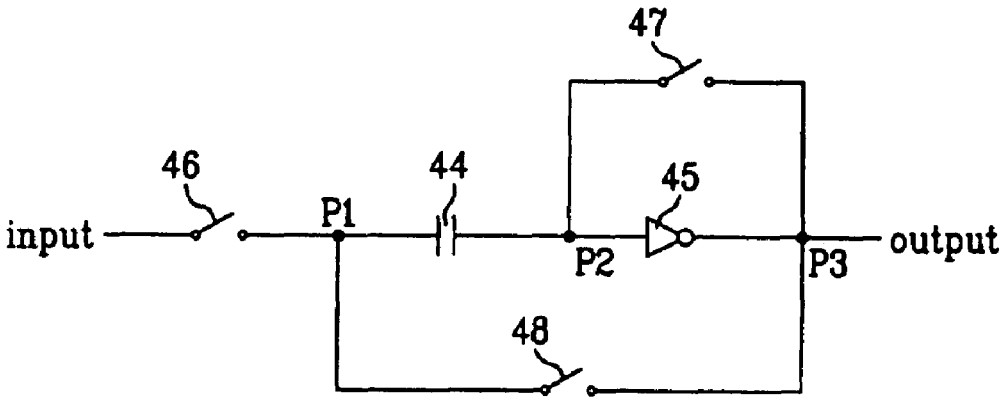
FIG. 5 Related Art
FIG. 5 is a schematic circuit diagram of an analog buffer circuit for an LCD device according to the related art.
Figure 6:
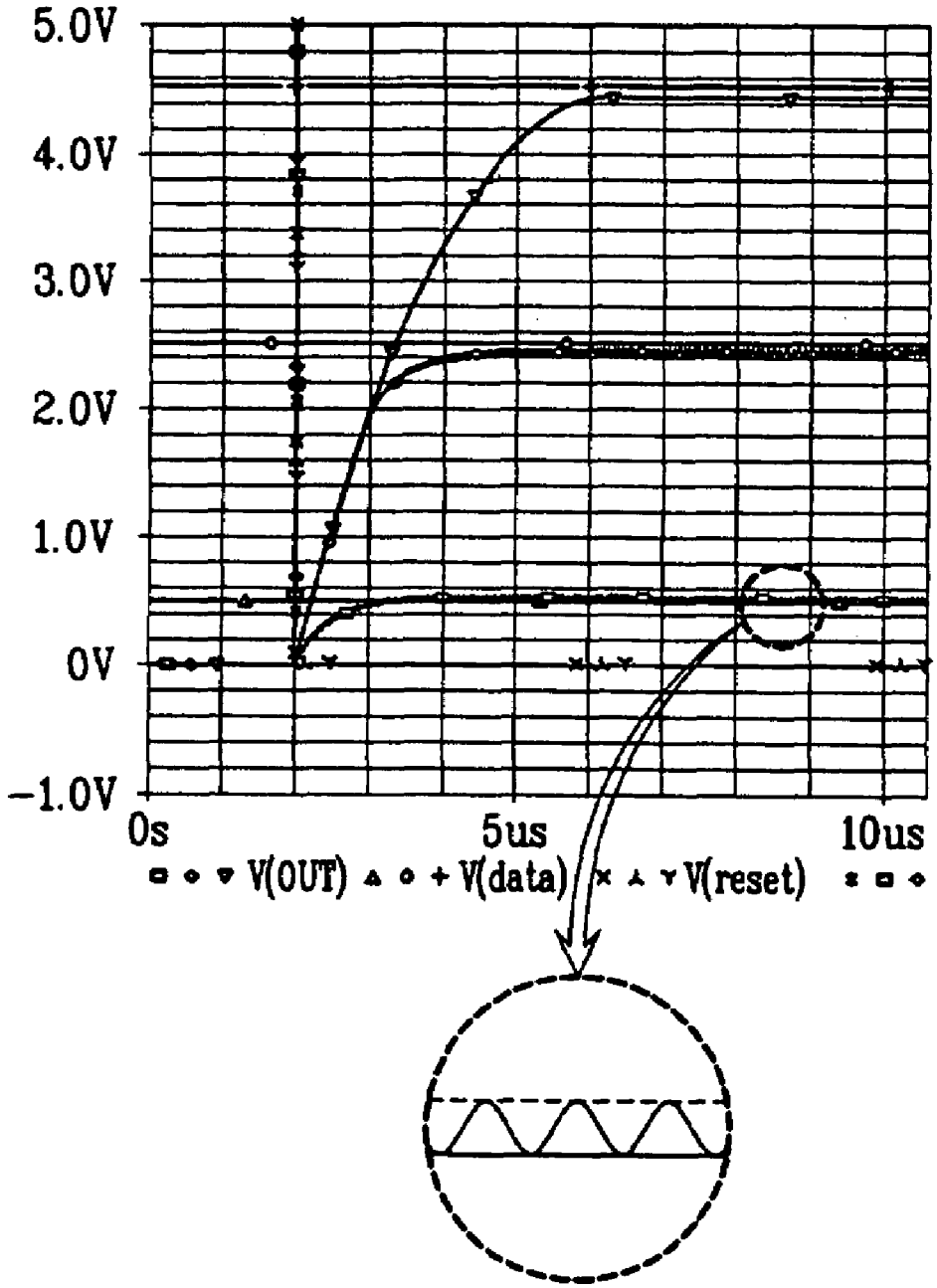
FIG. 6 Related Art
FIG. 6 is a diagram illustrating problems of an analog buffer circuit for an LCD device according to the related art.
Figure 7:
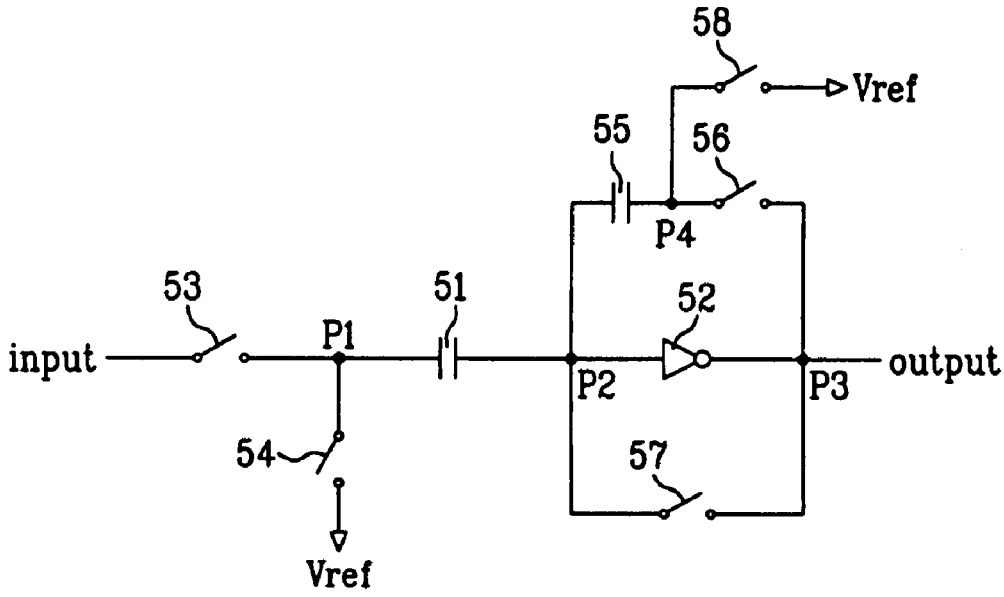
FIG. 7 is a schematic circuit diagram of an exemplary analog buffer circuit for an LCD device according to the present invention.

Reference will now be made in detail to the preferred embodiments of the present invention, examples of which are illustrated in the accompanying drawings. FIG. 7 is a schematic circuit diagram of an exemplary analog buffer circuit for an LCD device according to the present invention. In FIG. 7, an analog buffer circuit may include an input terminal INPUT, an output terminal OUTPUT, a first capacitor 51, an inverter 52, a first reset switch 53, a first feedback switch 54, a second capacitor 55, a second feedback switch 56, a second reset switch 57, and a third reset switch 58. The first capacitor 51 and the inverter 52 may be connected in series between the input terminal INPUT and the output terminal OUTPUT, the first reset switch 53 may be connected between the input terminal INPUT and the first capacitor 51 to reset the first capacitor 51, and the first feedback switch 54 may be connected to a first node P1 between the first capacitor 51 and the first reset switch 53. In addition, the second capacitor 55 and the second feedback switch 56 may be connected in series between a second node P2 and a third node P3, wherein the second node P2 may be connected between the first capacitor 51 and the inverter 52, and the third node P3 may be connected between the inverter 52 and the output terminal OUTPUT. Furthermore, the second reset switch 57 may be connected between the second node P2 and the third node P3 to reset the inverter 52, and the third reset switch 58 may be connected to a fourth node P4 between the second capacitor 55 and the second feedback switch 56 to reset the second capacitor 55. Accordingly, the third reset switch 58 and the first feedback switch 54 may be connected to external reference voltages $V_{ref}$, respectively.

In FIG. 7, when the first, second, and third reset switches 53, 57 and 58 are closed, a voltage corresponding to a difference between an analog data voltage input through the input terminal INPUT and a voltage input to the inverter 52 may be stored to the first and second capacitors 51 and 55. Subsequently, when the first and second feedback switches 54 and 56 are closed, the voltage stored in the first and second capacitors 51 and 55 may be output from the inverter 52. Then, a signal output through the output terminal OUTPUT may be monitored and feedback to a video signal of a digital/analog converter that may be provided, thereby controlling an output voltage. Accordingly, the second capacitor 55 may store the analog data voltage and the feedback from the inverter 52, whereby the output voltage of the inverter 52 may not be directly connected when the second feedback switch 56 is closed. Thus, power consumption of the analog buffer circuit may decrease, and ON operation of the analog buffer circuit may become stable with less oscillation. In addition, the output voltage Vout may be controlled by controlling a capacitance ratio to the first and second capacitors 51 and 55 between the input INPUT and the first and second feedback switches 54 and 56, thereby removing offset error generated by non-uniformity during the reset process.

Figure 8:
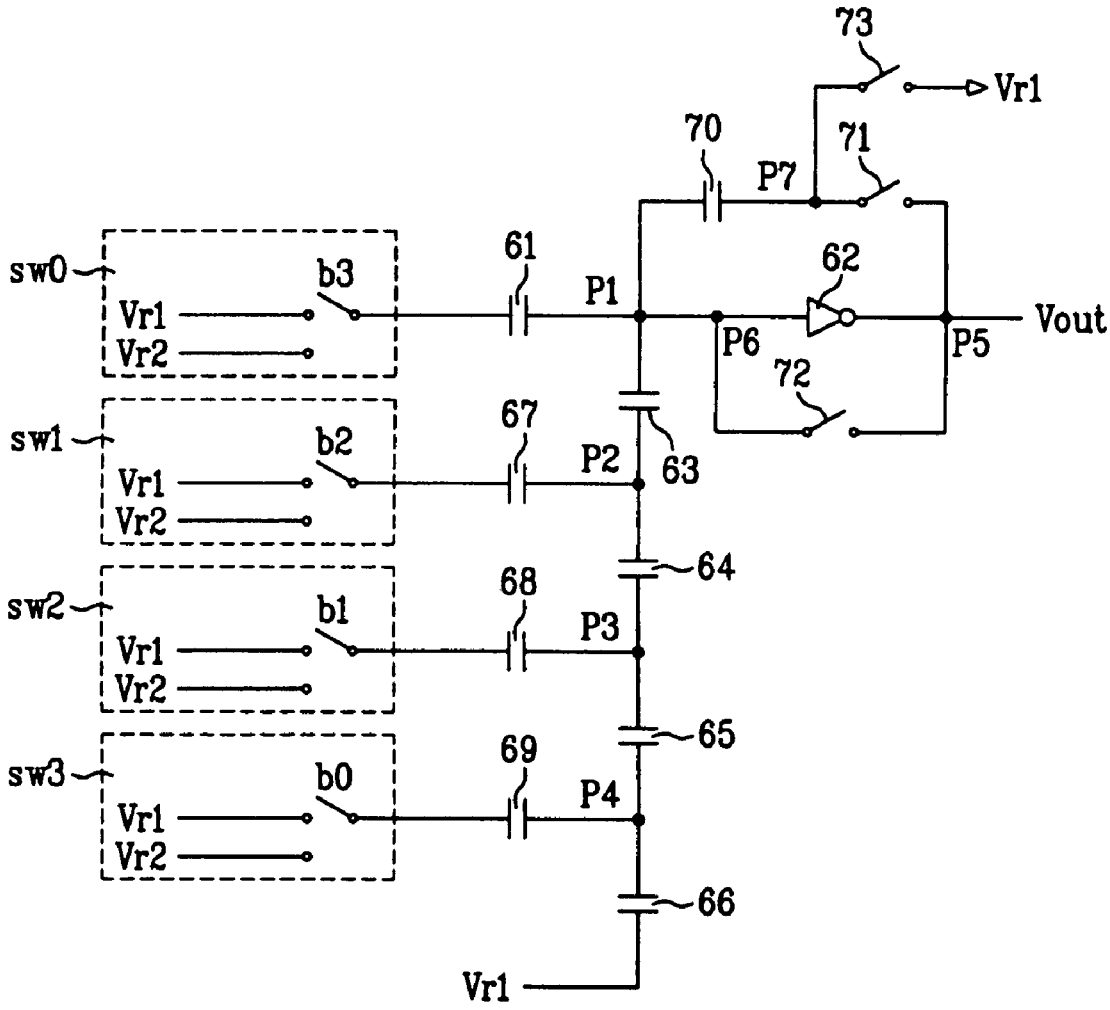
FIG. 8 is a schematic circuit diagram of another exemplary analog buffer circuit for an LCD device according to the present invention.

FIG. 8 is a schematic circuit diagram of another exemplary analog buffer circuit for an LCD device according to the present invention. In FIG. 8, an analog buffer circuit may include an input terminal, an output terminal Vout, a first capacitor 61, an inverter 62, second, third, fourth, and fifth capacitors 63, 64, 65, and 66, sixth, seventh, and eighth capacitors 67, 68, and 69, a ninth capacitor 70, a feedback switch 71, a first reset switch 72, and a second reset switch 73. The first capacitor 61 and the inverter 62 may be connected in series between the input terminal and the output terminal Vout to input first and second analog reference voltages Vr1 and Vr2 output from an MSB decoder (not shown) to a data line. In addition, the second, third, fourth, and fifth capacitors 63, 64, 65, and 66 may be connected to a first node P1 in series between the first capacitor 61 and the inverter 62. Then, first ends of the sixth, seventh, and eighth capacitors 67, 68, and 69 may be connected to second, third, and fourth nodes P2, P3, and P4, and second ends of the sixth, seventh, and eighth capacitors 67, 68, and 69 may be connected to the input terminal. Accordingly, the second node P2 may be connected between the second capacitor 63 and the third capacitor 64, the third node P3 may be connected between the third capacitor 64 and the fourth capacitor 65, and the fourth node P4 may be connected between the fourth capacitor 65 and the fifth capacitor 66. In addition, the ninth capacitor 70 and the feedback switch 71 may be connected in series between the first node P1 and a fifth node P5, wherein the first node P1 may be connected between the inverter 62 and the first capacitor 61, and the fifth node P5 may be connected between the inverter 62 and the output terminal Vout. The first reset switch 72 may be connected between the fifth node P5 and a sixth node P6 to reset the inverter 62, wherein the sixth node P6 may be connected between the first capacitor 61 and the inverter 62. The second reset switch 73 may be connected to a seventh node P7 between the ninth capacitor 70 and the feedback switch 71 to reset the ninth capacitor 70.

In FIG. 8, the input terminal may be comprised of first, second, third, and fourth switches sw0, sw1, sw2, and sw3 for receiving uppermost 4 bits of an 8-bit digital pixel data, and sampling any one of the first and second analog reference voltages Vr1 and Vr2 (Vr2>Vr1) determined by the MSB decoder (not shown) according to lowermost 4 bits of b3, b2, b1, and b0 value. In addition, a driving circuit for the LCD device according to the present invention may be formed as a C-string type, for switching the first capacitor to the first and second analog reference voltages Vr1 and Vr2 on the basis of input digital data, whereby the driving circuit may simultaneously have both the digital-to-analog conversion (DAC) function and the analog buffer function. For example, when the b3, b2, b1, and b0 value of the lowermost 4 bits is '0', the first analog reference voltage Vr1 may be sampled. Similarly, when the b3, b2, b1, and b0 value of the lowermost 4 bits is '1', the second analog reference voltage Vr2 may be sampled. In addition, an intensity of the analog output voltage may be controlled according to a capacitance of the first and second capacitors.

Figure 9:
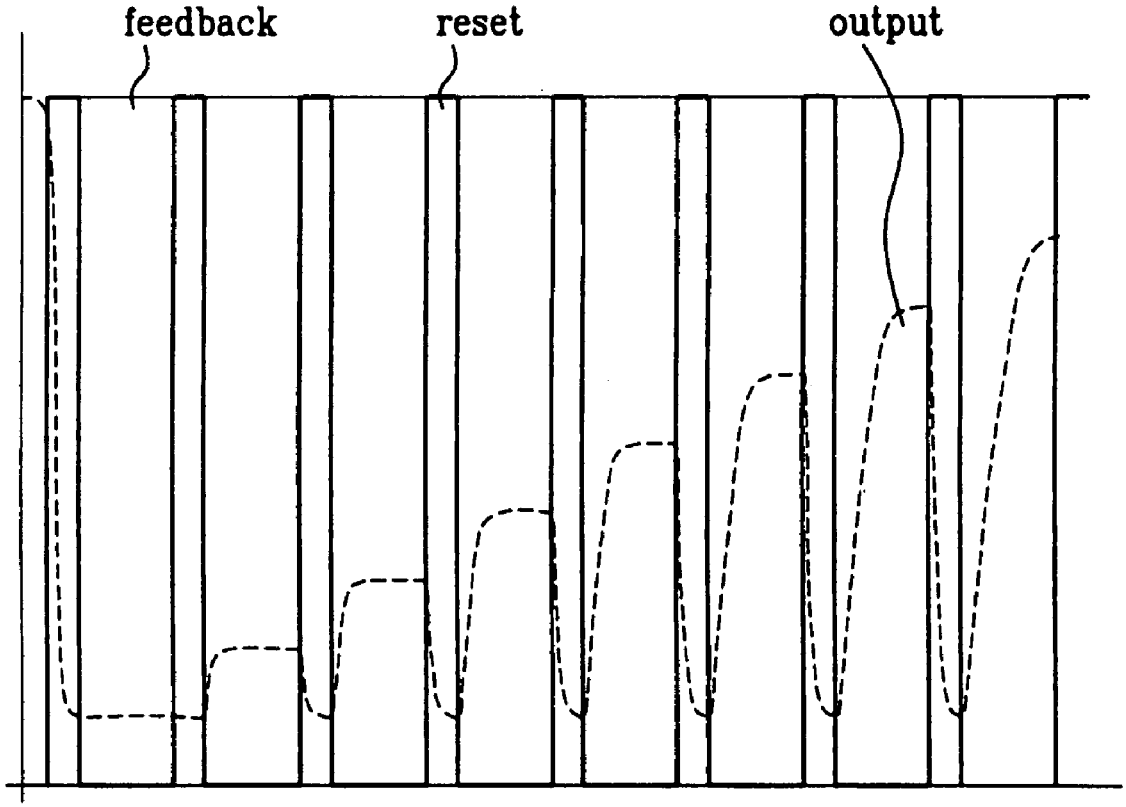
FIG. 9 is an operational simulation diagram of another exemplary analog buffer circuit for an LCD device according to the present invention.

FIG. 9 is an operational simulation diagram of another exemplary analog buffer circuit for an LCD device according to the present invention. In FIG. 9, upon reset, the first, second, third, and fourth switches sw0, sw1, sw2, and sw3 and the second reset switch 73 may be connected to the first analog reference voltage Vr1 and the feedback switch 71 may be opened, whereby the first reset switch 72 may be ON. During feedback, the first, second, third, and fourth switches sw0, sw1, sw2, and sw3 may selectively sample one of the first analog reference voltage Vr1 and the second analog reference voltage Vr2 according to the lowermost 4 bits of b0, b, b2, and b3, and the second reset switch 73 and the first reset switch 72 may be open, whereby the feedback switch 71 may be ON, thereby buffering the DAC output, and outputting the buffered DAC output.

According to the present invention, the analog buffer circuit for the LCD device may have the following advantages. First, when the reset switch is closed, the input and output of the inverter may not be directly connected by the additional inverter feedback capacitor, thereby decreasing power consumption and obtaining the stable operation. In addition, it may be possible to remove the offset error by the non-uniformity upon the reset process. Furthermore, it may be possible to change an intensity of the analog output voltage to the capacitance ratio of the first and second capacitors, thereby controlling the analog output voltage. Furthermore, the first capacitor may be formed as a C-string type for switching the first capacitor to the first and second analog reference voltages Vr1 and Vr2 on the basis of input digital data, whereby the driving circuit may simultaneously have both the digital-to-analog conversion (DAC) function and the analog buffer function.

It will be apparent to those skilled in the art that various modifications and variations can be made in the analog buffer circuit for a liquid crystal display device of the present invention without departing from the spirit or scope of the invention. Thus, it is intended that the present invention cover the modifications and variations of this invention provided they come within the scope of the appended claims and their equivalents.

What is claimed is:

1. An analog buffer circuit for a liquid crystal display (LCD) device, comprising:

a first capacitor and an inverter connected in series between an input terminal and an output terminal;

a first reset switch connected between the input terminal and the first capacitor to reset the first capacitor;

a first feedback switch connected to a first node between the first capacitor and the first reset switch;

a second capacitor and a second feedback switch connected in series between a second node and a third node, the second node connected between the first capacitor and the inverter, and the third node connected between the inverter and the output terminal;

a second reset switch connected between the second node and the third node to reset the inverter; and a third reset switch connected to a fourth node between the second capacitor and the second feedback switch to reset the second capacitor.

2. The analog buffer circuit of claim 1, wherein the first feedback switch and the third reset switch are connected to external reference voltages.

3. The analog buffer circuit of claim 1, wherein an output voltage is controlled by a capacitance ratio of the first and second capacitors between the input terminal and the first and second feedback switches.

4. An analog buffer circuit for a liquid crystal display (LCD) device, comprising:

a first capacitor and an inverter connected in series between an input terminal and an output terminal to input first and second analog reference voltages to a data line;

second, third, fourth, and fifth capacitors connected in series to a first node between the first capacitor and the inverter;

sixth, seventh, and eighth capacitors having first ends connected to second, third, and fourth nodes, and second ends connected to the input terminal, the second node connected between second capacitor and the third capacitor, the third node connected between the third capacitor and the fourth capacitor, and the fourth node connected between the fourth capacitor and the fifth capacitor;

a ninth capacitor and a feedback switch connected in series between a first node and a fifth node, the first node connected between the inverter and the first capacitor, and the fifth node connected between the inverter and the output terminal;

a first reset switch connected between the fifth node and a sixth node to reset the inverter, the sixth node connected between the first capacitor and the inverter; and a second reset switch connected to a seventh node to reset the ninth capacitor, the seventh node connected between the ninth capacitor and the feedback switch.

5. The analog buffer circuit of claim 4, wherein the input terminal includes of first, second, third, and fourth switches for receiving uppermost 4 bits of an 8-bit digital pixel data, and for sampling any one of the first and second analog reference voltages determined by an MSB decoder according to lowermost 4 bits of b3, b2, b1, and b0 value.

6. The analog buffer circuit of claim 4, wherein the first capacitor is formed as a 'C-string' type to simultaneously obtain both digital-to-analog converter (DAC) and analog buffer functions.

7. The analog buffer circuit of claim 4, wherein the second capacitor has a value according to the 'C-string' type first capacitor.

8. The analog buffer circuit of claim 4, wherein the first analog reference voltage is different from the second analog reference voltage.

9. The analog buffer circuit of claim 4, wherein the second analog reference voltage is greater than the first analog reference voltage.

* * * * *